US011627801B2

(12) United States Patent
Chen

(10) Patent No.: US 11,627,801 B2
(45) Date of Patent: Apr. 18, 2023

(54) COMBINED STORAGE SHELF

(71) Applicant: Protrend Co., Ltd., Taipei (TW)

(72) Inventor: Shun-Yi Chen, Taipei (TW)

(73) Assignee: PROTREND CO., LTD., Taipei (TW)

( * ) Notice: Subject to any disclaimer, the term of this patent is extended or adjusted under 35 U.S.C. 154(b) by 0 days.

(21) Appl. No.: 17/679,420

(22) Filed: Feb. 24, 2022

(65) Prior Publication Data

US 2022/0378197 A1 Dec. 1, 2022

(30) Foreign Application Priority Data

May 28, 2021 (TW) ..... 110119383
Jan. 27, 2022 (TW) ..... 111103762

(51) Int. Cl.
*A47B 57/48* (2006.01)
*A47B 47/00* (2006.01)
*A47B 57/26* (2006.01)
*A47B 57/54* (2006.01)

(52) U.S. Cl.
CPC ..... *A47B 57/48* (2013.01); *A47B 47/0083* (2013.01); *A47B 57/265* (2013.01); *A47B 57/545* (2013.01)

(58) Field of Classification Search
CPC ..... A47B 57/48; A47B 57/00; A47B 57/06; A47B 57/26; A47B 57/265; A47B 57/30; A47B 57/20; A47B 57/54; A47B 57/545; A47B 57/562; A47B 57/567; A47B 47/0083; A47B 47/021; A47B 47/024; A47B 96/06; A47B 96/1408
USPC ..... 211/187
See application file for complete search history.

(56) References Cited

U.S. PATENT DOCUMENTS 4,079,678 A * 3/1978 Champagne ..... A47B 57/545 108/106
4,592,286 A * 6/1986 Trubiano ..... A47B 57/545 211/208
6,044,988 A * 4/2000 Yang ..... A47B 57/265 211/187
6,253,687 B1 * 7/2001 McAllister ..... A47B 57/545 108/107
6,253,933 B1 * 7/2001 Yang ..... A47B 57/545 211/187
6,431,090 B1 * 8/2002 Davis ..... A47B 57/04 108/107
7,059,484 B1 * 6/2006 Goldberg ..... A47B 47/0083 211/187
7,478,971 B2 * 1/2009 Li ..... A47B 57/562 403/398
7,543,540 B2 * 6/2009 Tatematsu ..... F16B 12/46 108/192

(Continued)

*Primary Examiner* — Jennifer E. Novosad
(74) *Attorney, Agent, or Firm* — WPAT, PC

(57) ABSTRACT

A combined storage shelf, including column combinations, connection and combination fasteners, beam structures, and storage layers. The column combinations include assembly holes. A snap-fit portion of a first connection and combination fastener is snapped to an assembly hole, to fix the first connection and combination fastener to the column combination. The engagement structure of the second connection and combination fastener corresponds to the engagement structure of the first connection and combination fastener, so that the first connection and combination fastener and the second connection and combination fastener are assembled together.

6 Claims, 14 Drawing Sheets

(56) References Cited

U.S. PATENT DOCUMENTS

| | | | | |
|---|---|---|---|---|
| 8,016,140 | B2 * | 9/2011 | Hsieh | A47B 47/0083 211/187 |
| 8,505,752 | B2 * | 8/2013 | Shinozaki | A47B 57/34 211/208 |
| 8,627,966 | B2 * | 1/2014 | Jarvis | A47B 57/545 211/187 |
| 8,678,207 | B2 * | 3/2014 | Shimazaki | A47B 57/545 211/208 |
| 8,887,647 | B2 * | 11/2014 | Sabounjian | A47B 57/10 211/187 |
| 9,167,915 | B1 * | 10/2015 | Lau | A47B 57/545 |
| 9,314,098 | B2 * | 4/2016 | Sabounjian | A47B 57/545 |
| 9,380,868 | B1 * | 7/2016 | Fu | A47B 47/0083 |
| 9,468,294 | B2 * | 10/2016 | Fu | A47B 57/34 |
| 10,058,174 | B1 * | 8/2018 | Tang | A47B 57/545 |
| 10,080,437 | B1 * | 9/2018 | Tang | A47B 47/0091 |
| 10,376,048 | B2 * | 8/2019 | Kessell | A47B 57/26 |
| 11,419,412 | B1 * | 8/2022 | Chen | A47B 96/1441 |
| 2009/0321597 | A1 * | 12/2009 | Matsumoto | A47G 25/0607 248/219.4 |
| 2010/0108631 | A1 * | 5/2010 | McAllister | A47B 57/545 211/187 |
| 2016/0037915 | A1 * | 2/2016 | Fu | A47B 57/34 211/187 |
| 2017/0224106 | A1 * | 8/2017 | Sabounjian | A47B 47/0083 |
| 2018/0317651 | A1 * | 11/2018 | Tang | A47B 57/545 |
| 2019/0343277 | A1 * | 11/2019 | Sabounjian | A47B 47/0083 |

* cited by examiner

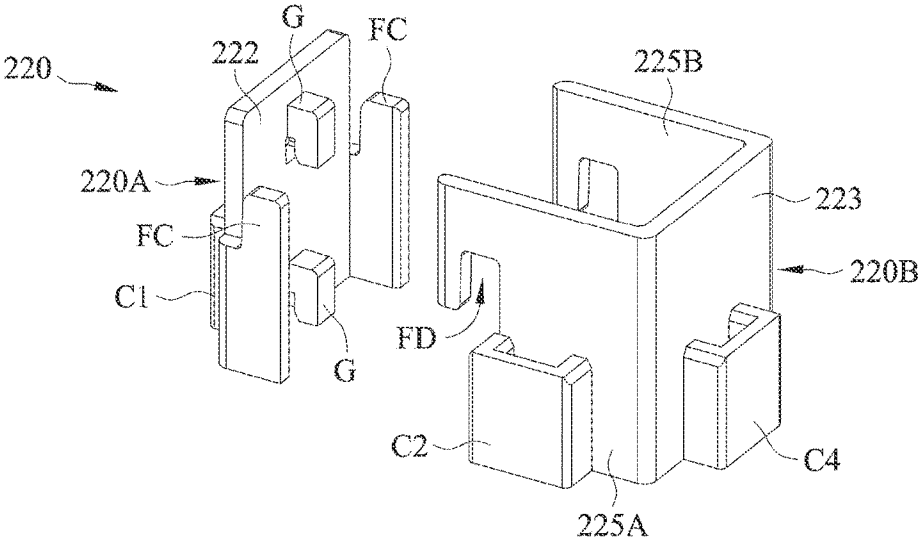
FIG. 11B
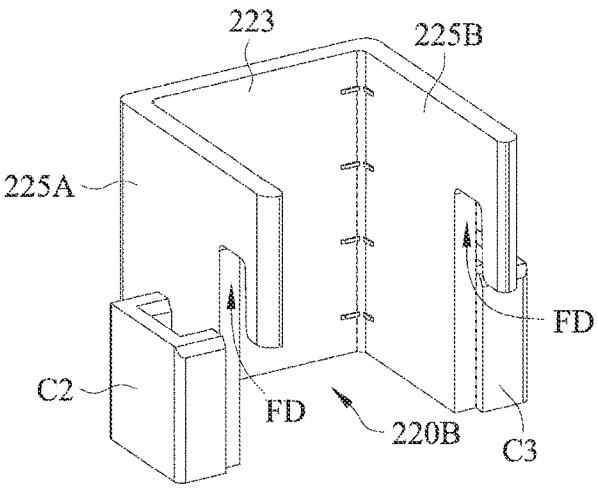
FIG. 11C
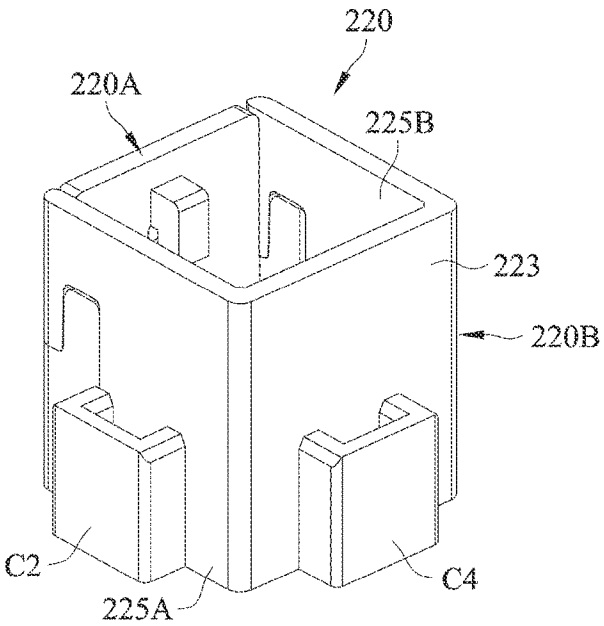
FIG. 11A
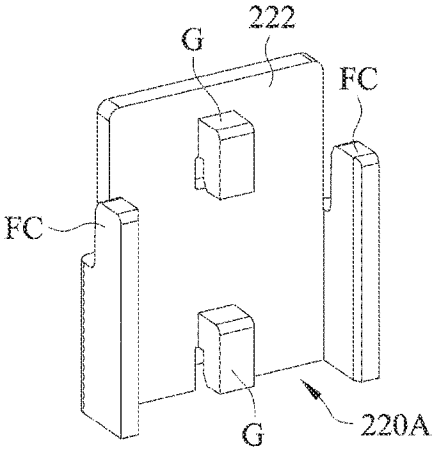

COMBINED STORAGE SHELF

CROSS REFERENCE TO RELATED APPLICATION

This application claims the benefits of Taiwan application Serial No. 110119383, filed on May 28, 2021, and Taiwan application Serial No. 111103762, filed on Jan. 27, 2022, and the disclosures of which are incorporated by references herein in its entirety.

BACKGROUND

Technical Field

The present invention relates to a storage shelf, and in particular, to a combined storage shelf.

Related Art

Combined furniture may be randomly combined into appropriate shapes and sizes according to the requirements of home, office, or workplace, and is becoming more and more popular due to the advantages of convenient transportation and storage.

A conventional combined storage shelf is mostly assembled by using circular columns, which cannot be connected horizontally. That is, the columns cannot be assembled horizontally and in parallel, and there are limitations in assembly. Further, if wooden boards are to be assembled on the storage shelf, screw lock tools are generally used to lock the wooden boards. However, it is difficult to position and inconvenient to assemble the wooden boards. Moreover, the existing storage shelf does not have a structural design for assembling wooden boards. In addition, tools are required when the combined storage shelf is assembled, causing inconvenience in assembly as well as in use.

Therefore, how to resolve the problems encountered when the conventional method is adopted is one of the issues to be resolved by the industry.

SUMMARY

The present invention provides a combined storage shelf, which can be assembled without using locking screws and tools, thereby achieving a simple and stable structure of the entire combined storage shelf. In addition, the combined storage shelf is easy to assemble, and has flexibility in the overall assembly.

An embodiment of the present invention provides a combined storage shelf, comprising at least four column combinations, a plurality of connection and combination fasteners, a plurality of beam structures, and a plurality of storage layers. Each of the column combinations comprises a plurality of assembly holes. Each of the connection and combination fasteners comprises a first connection and combination fastener and a second connection and combination fastener. Each of the first connection and combination fastener and the second connection and combination fastener comprises a body portion, at least one fastening structure, and at least one engagement structure. The at least one fastening structure is formed on an outer side of the body portion. The at least one engagement structure is disposed on two sides of the body portion. The first connection and combination fastener comprises at least one snap-fit portion. The snap-fit portion is snapped to a corresponding assembly hole, to fasten the first connection and combination fastener to the column combination. The engagement structure of the second connection and combination fastener corresponds to the engagement structure of the first connection and combination fastener, so that the first connection and combination fastener and the second connection and combination fastener are assembled together. Each of the beam structures comprises two first beam members, two second beam members, four beam connecting fasteners, and a plurality of beam fastening structures. The beam connecting fasteners are configured to connect the first beam members and the second beam members. The beam fastening structures are disposed in the beam connecting fasteners. Each of the beam fastening structures is snapped into a corresponding fastening structure, so that the beam structures are connected to the corresponding connection and combination fasteners. The storage layers are disposed between the column combinations, and the beam structures support the corresponding storage layers.

In order to make the present invention more comprehensible, embodiments accompanied with figures are described in detail below.

BRIEF DESCRIPTION OF THE DRAWINGS

FIG. 11A is a schematic diagram of a connection and combination fastener according to another embodiment of the present disclosure.

FIG. 11B is an exploded view of a connection and combination fastener according to another embodiment of the present disclosure.

FIG. 11C is a schematic diagram of FIG. 11B from different angles.

DETAILED DESCRIPTION

Figure 1:
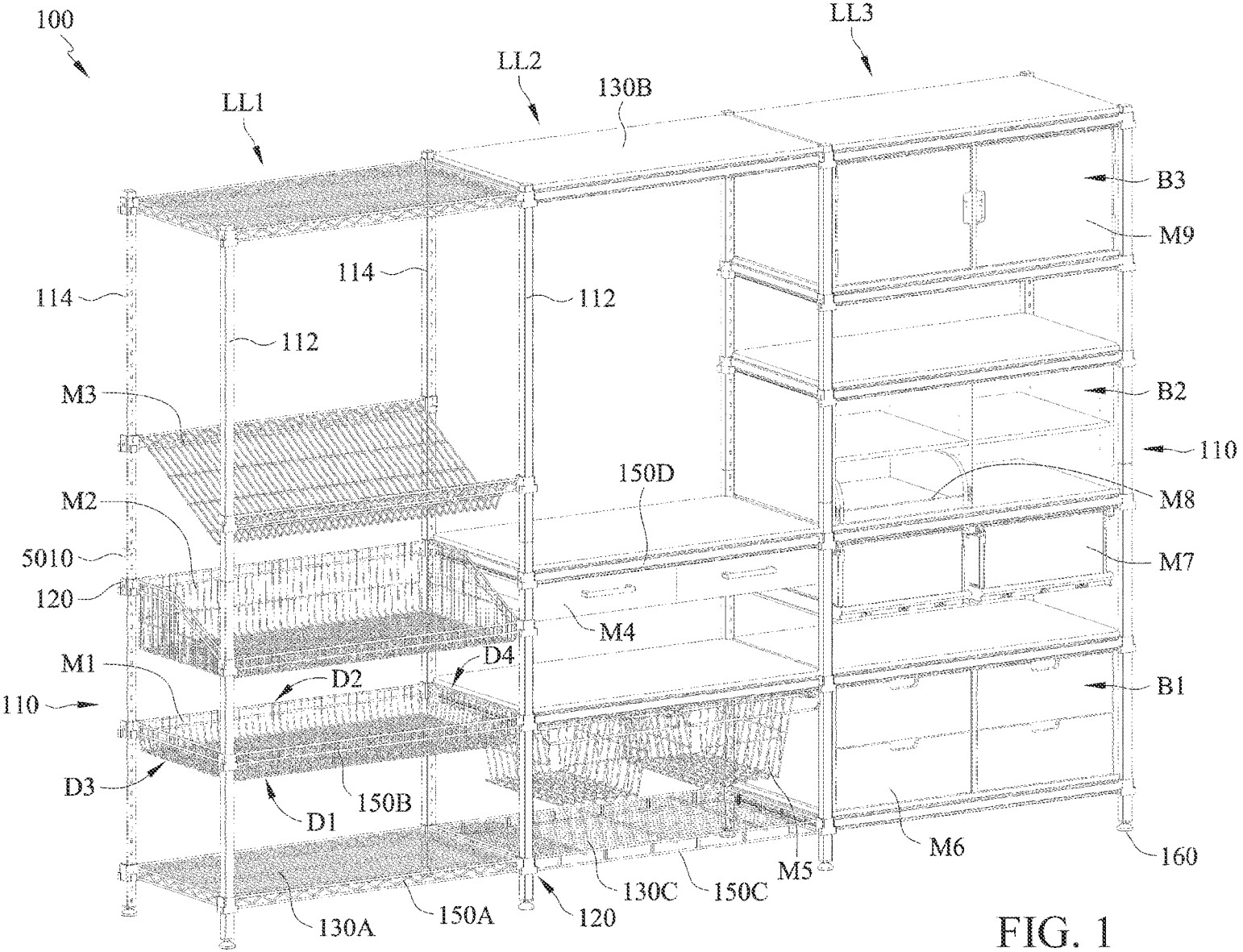
FIG. 1 is a schematic diagram of a combined storage shelf according to an embodiment of the present disclosure.

The following further describes specific implementations of the present invention with reference to the accompanying drawings and the embodiments. The following embodiments are merely used for more clearly describing the technical solutions of the present invention, and are not intended to limit the protection scope of the present invention.

It should be noted that, in description of the embodiments, terms such as "first" and "second" are used for describing different components, and the components are not limited by such terms. In the description of the embodiments, the "coupled" or "connected" may refer to two or more components in direct physical or electrical contact with each other, or in indirect physical or electrical contact with each other. Moreover, "coupled" or "connected" may further refer to a mutual operation or action of two or more components.

In addition, for convenience and clarity of the description, thicknesses or sizes of the components in the drawings expressed in an exaggerated, omitted or general manner are used to help a person skilled in the art to understand and read, and the sizes of components are not completely actual sizes and are not intended to limit restraint conditions under which the present invention can be implemented and therefore have no technical significance. Any modification to the structure, change to the proportional relationship or adjustment on the size should fall within the scope of the technical content disclosed by the present invention without affecting the effects and the objectives that can be achieved by the present invention. Same reference numerals are used to denote same or similar components in all of the drawings.

FIG. 1 is a schematic diagram of a combined storage shelf according to an embodiment of the present invention. Referring to FIG. 1, in this embodiment, a combined storage shelf 100 includes a plurality of column combinations 110 (for example, four column combinations 110 in FIG. 1), a plurality of connection and combination fasteners 120, storage layers (for example, one or any combination of a plurality of different types of storage layers such as a first storage layer 130A, a second storage layer 130B, and a third storage layer 130C), and beam structures (for example, one or any combination of beam structures 150A, 150B, 150C or 150D), through which a combined storage shelf of various combinations can be formed.

A quantity of column combinations 110, a quantity of different types of storage layers such as the first storage layer 130A, the second storage layer 130B, and the third storage layer 130C, the related connection and combination fasteners 120, and the beam structures 150A, 150B, 150C, and 150D in the present disclosure can be adjusted according to actual conditions. For example, left and right column combinations 110 are fastened to each other by disposing the beam structures (for example, the beam structure 150A, 150B, 150C, or 150B) engaged with fastening structures C1 (in FIG. 3B) of the connection and combination fasteners 120. In addition, one row of at least one storage layer (for example, the first storage layer 130A, the second storage layer 130B, or the third storage layer 130C) of the same or different types is disposed correspondingly on a combined storage shelf. The first storage layer 130A and the third storage layer 130C are storage layers formed by iron wires, and the second storage layer 130B is a flat storage layer. That is, the present disclosure can achieve the joint assembly by using the column combinations 110, the beam structures (for example, the beam structures 150A, 150B, 150C or 150D), and the connection and combination fasteners 120 without tools for assembly. In addition, the beam structures (for example, the beam structures 150A, 150B, 150C or 150D) can stabilize the entire combined storage shelf 100, and the column combinations 110 can be assembled horizontally and in parallel by using the connection and combination fasteners 120. That is, as shown in FIG. 1, there are four column combinations 110, and every two column combinations 110 form a set of storage shelf, which are assembled horizontally and in parallel to form the combined storage shelf 100 of two sets (or even more sets) of storage shelves.

Taking FIG. 1 as an example, there are a first row LL1, a second row LL2, and a third row LL3 from left to right in sequence. The first row LL1 includes four layers, the second row LL2 includes three layers, and the third row LL3 includes five layers. In an embodiment, the heights of the column combinations 110 in the first row LL1, the second row LL2, and the third row LL3 can be increased through assembly of connectors 5010. It should be noted that, in the present disclosure, the combined storage shelf 100 can be assembled into a first storage shelf body M1, a second storage shelf body M2, a third storage shelf body M3, a drawer M4, a storage basket M5, a drawer M6, a plastic storage box M7, a box body M8, and a door cabinet M9.

In an embodiment, in the present disclosure, at least one fitting (for example, a sliding groove structure or a drawer track structure) may be disposed to improve the assembly flexibility of the present disclosure. In another embodiment, the stability of the entire combined storage shelf 100 can be improved by further disposing feet 160 under the column combinations 110.

In this embodiment, as shown in FIG. 1, the combined storage shelf 100 includes four column combinations 110, and each column combination 110 includes a first column 112 and a second column 114. It should be noted that, in fact, the configurations and types of the first column 112 and the second column 114 are same, but they are named with different component names respectively for the placement and disposed positions and for the convenience of implementation and description. Two first columns 112 in adjacent column combinations 110 are respectively located at a front side D1 of the combined storage shelf 100, and the two first columns 112 are also separated by a distance. Two second columns 114 in the adjacent column combinations 110 are respectively located at a rear side D2 of the combined storage shelf 100, and the two second columns 114 are also separated by a distance. In addition, in a left side D3 and a right side D4 of the combined storage shelf 100, the first column 112 and the corresponding second column 114 are separated by a distance. The front side D1, the rear side D2, the left side D3, and the right side D4 are defined based on a relative position relationship formed between the two adjacent column combinations 110.

Figure 2A:
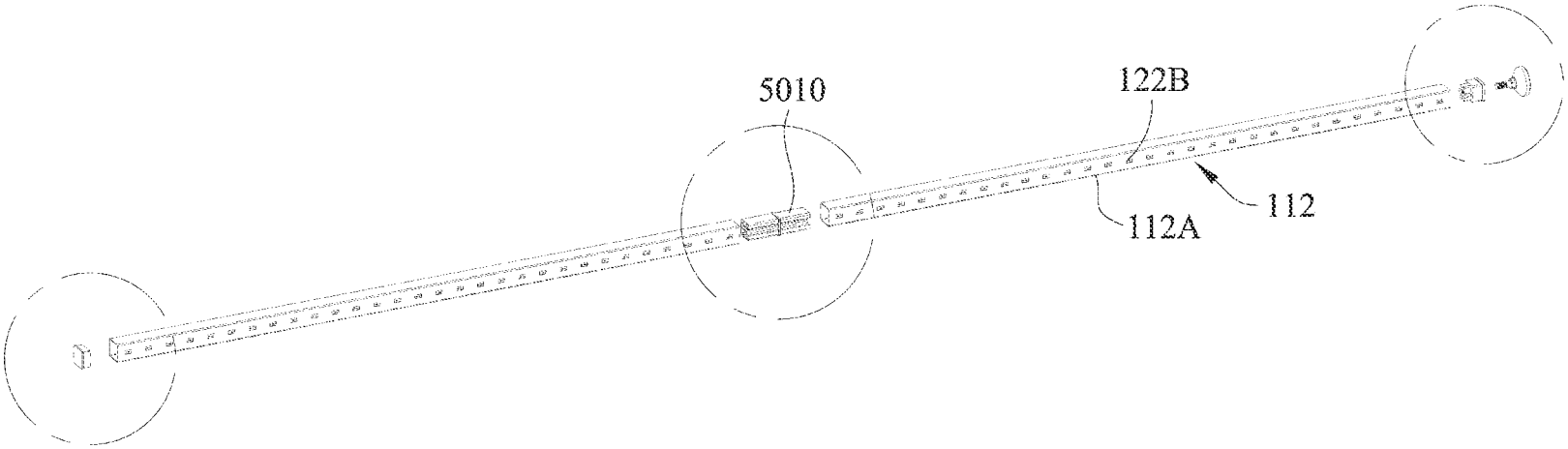
FIG. 2A is a partial schematic exploded view of a first column of FIG. 1.
Figure 2B:
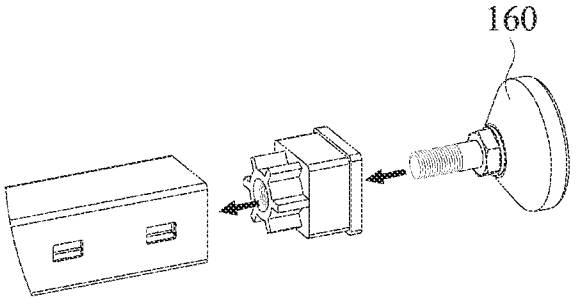
FIG. 2B is a partial enlarged view of FIG. 2A.
Figure 2B:
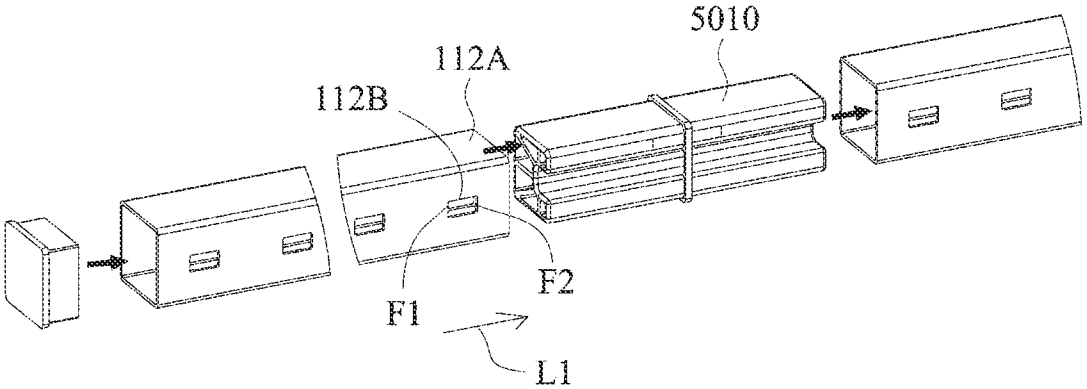

In this embodiment, as shown in FIG. 2A and FIG. 2B, the first column 112 includes a tube body 112A and a plurality of assembly holes 112B. The tube body 112A is a hollow square tube. In an embodiment, connectors 5010 can be used to combine a plurality of tube bodies 112A to achieve the required length of the first column 112. Similarly, the length of the second column 114 can be extended by using the connector 5010 when needed.

In this embodiment, the assembly holes 112B are sequentially arranged on one surface of the tube body 112A of the first column 112. However, this is not limited in the present invention. In another embodiment, the assembly holes 112B are sequentially arranged on at least two surfaces or at least three surfaces of the tube body 112A of the first column 112, which depends on actual conditions. In this embodiment, in an assembly direction L1, each assembly hole 112B is of a square structure. That is, an opening size of a first side F1 of the assembly hole 112B is approximately the same as an opening size of a second side F2 of the assembly hole. As shown in FIG. 1 and FIG. 2B, the assembly direction L1 is defined as a top-to-bottom direction. Similarly, because the structure of the second column 114 is the same as that of the first column 112, the second column 114 also includes a tube body and assembly holes, and reference may be made to the tube body 112A and the assembly holes 112B of the first column 112. As shown in FIG. 1, the assembly holes of the first column 112 and the assembly holes of the second column 114 face each other.

Figure 3B:
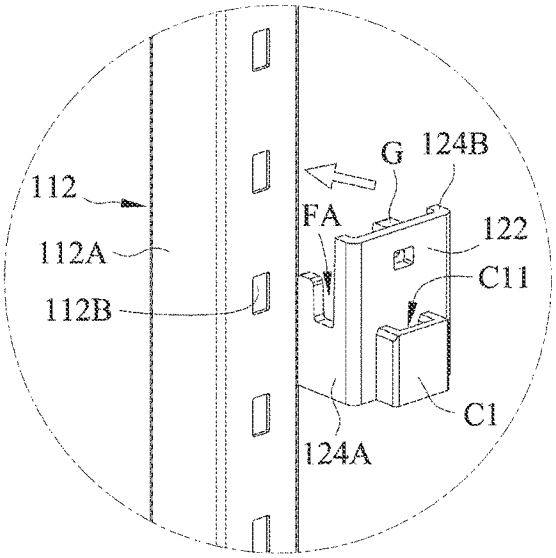
FIG. 3B is a partial enlarged view of a region A1 of FIG. 3A.
Figure 3C:
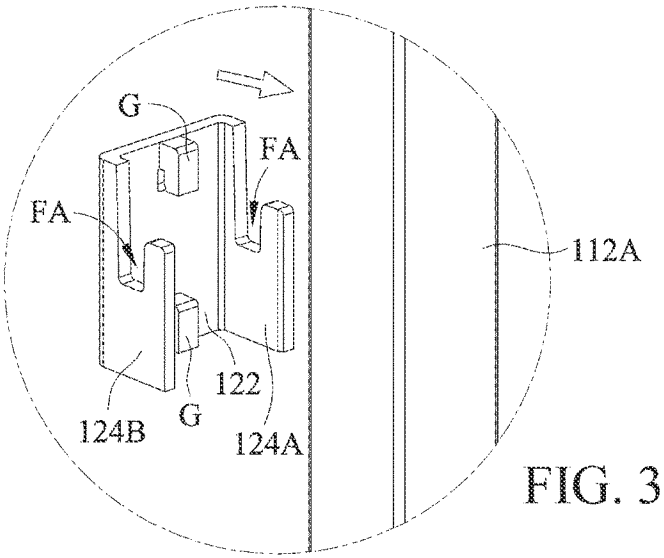
FIG. 3C is a schematic diagram of a region A2 of FIG. 3A from another perspective.
Figure 3A:
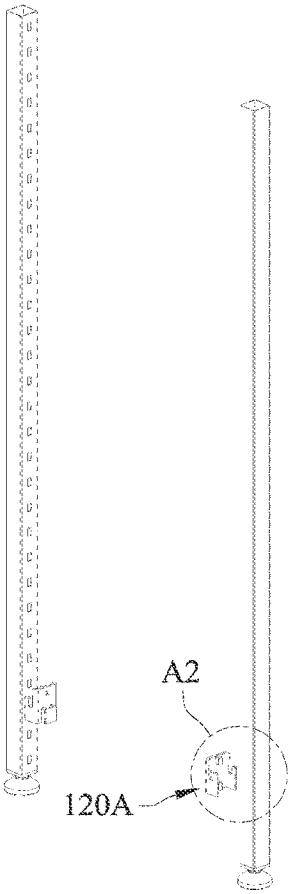
FIG. 3A is a schematic diagram of a connection and combination fastener before assembly according to an embodiment of the present disclosure.
Figure 3A:
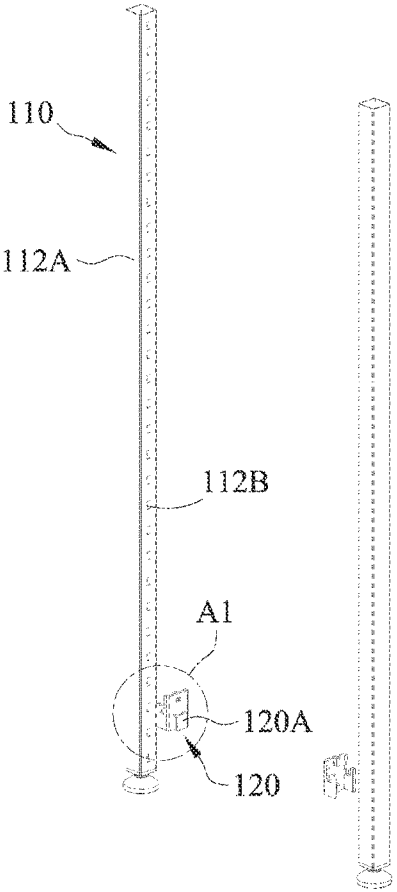
Figure 4B:
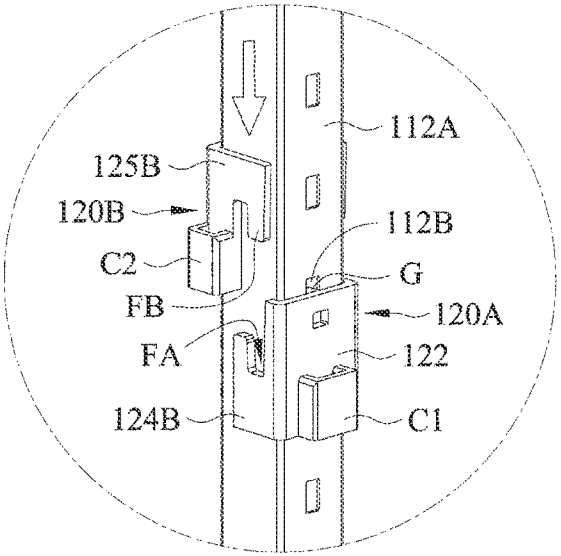
FIG. 4B is a partial enlarged view of a region A3 of FIG. 4A.
Figure 4C:
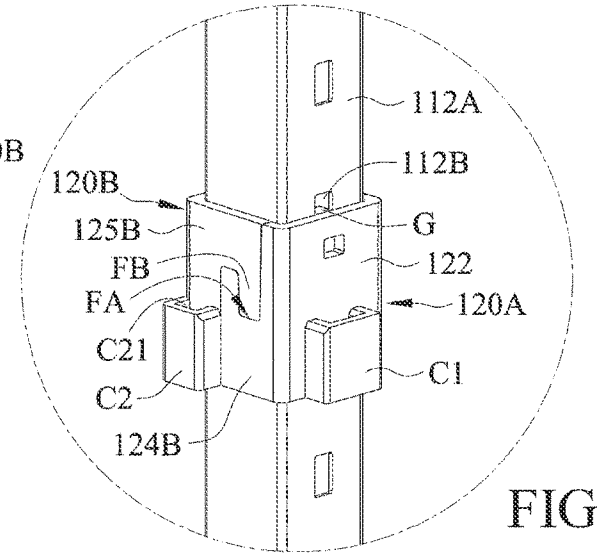
FIG. 4C is a partial enlarged view of a region A4 of FIG. 4A.
Figure 4A:
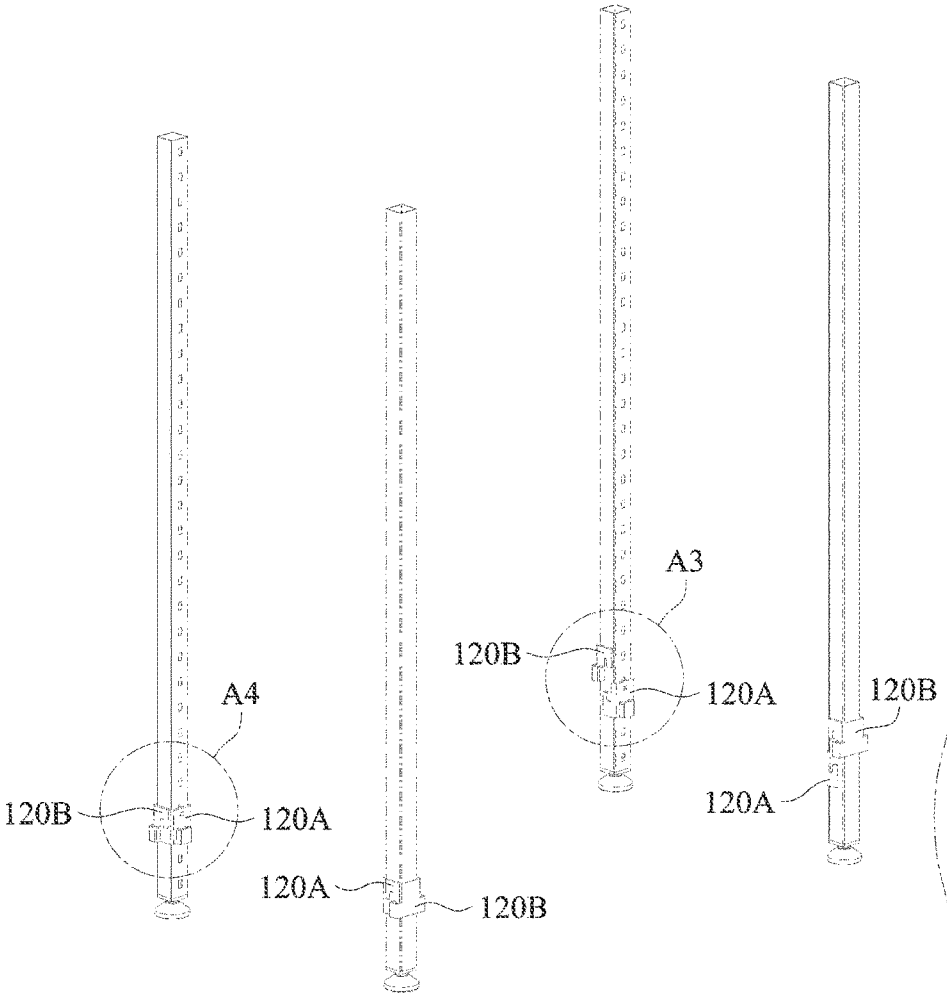
FIG. 4A is a schematic diagram of an assembly process of a connection and combination fastener according to an embodiment.
Figure 5B:
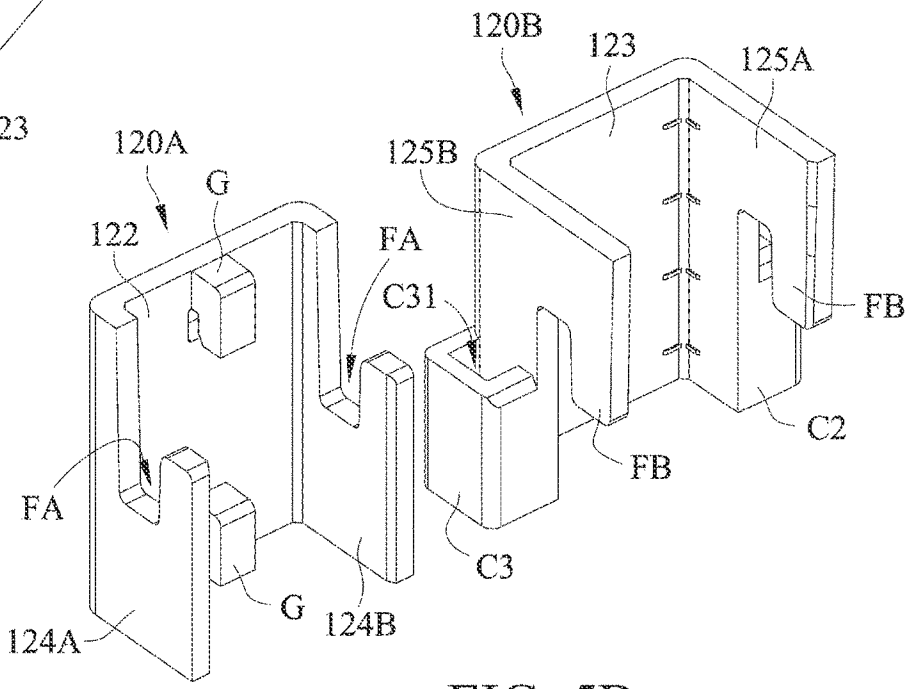
FIG. 5B is an exploded view of a connection and combination fastener from a perspective.
Figure 5A:
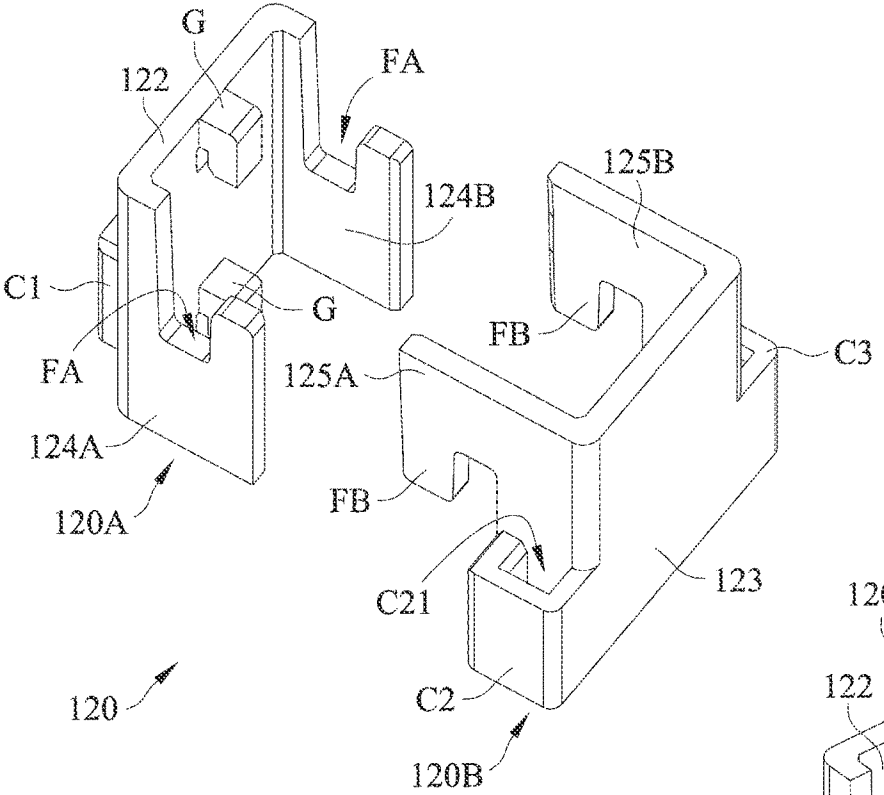
FIG. 5A is an exploded view of a connection and combination fastener.

FIG. 3A is a schematic diagram of a connection and combination fastener before assembly according to an embodiment of the present disclosure. FIG. 3B is a partial enlarged view of a region A1 of FIG. 3A. FIG. 3C is a schematic diagram of a region A2 of FIG. 3A from another perspective. FIG. 4A is a schematic diagram of an assembly process of a connection and combination fastener according to an embodiment. FIG. 4B is a partial enlarged view of a region A3 of FIG. 4A. FIG. 4C is a partial enlarged view of a region A4 of FIG. 4A. FIG. 5A is an exploded view of a connection and combination fastener. FIG. 5B is an exploded view of a connection and combination fastener from a perspective. Referring to FIG. 1 to FIG. 5B, in the present disclosure, the connection and combination fastener 120 includes a first connection and combination fastener 120A and a second connection and combination fastener 120B. The first connection and combination fastener 120A includes a first body portion 122, a first side portion 124A, a second side portion 124B, at least one fastening structure C1, at least one snap-fit portion G, and at least one engagement structure FA. Two sides of the first body portion 122 respectively extend to form the first side portion 124A and the second side portion 124B. The engagement structure FA is formed on each of the first side portion 124A and the second side portion 124B. In this embodiment, the engagement structure FA is a recess which is recessed in the first side portion 124A and the second side portion 124B. The snap-fit portion G is a protrusion, which is formed on an inner side of the first body portion 122. The quantity of snap-fit portions G is, for example, two, whose size needs to match the configuration. The fastening structure C1 is an accommodating portion including a hole C11 (as shown in FIG. 3B), which is formed on an outer side of the first body portion 122. As shown in FIG. 3A to FIG. 3C, the first connection and combination fastener 120A is assembled in a direction of the assembly holes 112B. Each snap-fit portion G is snapped to the corresponding assembly hole 112B, to fix the first connection and combination fastener 120A to the first column 112. Similarly, the first connection and combination fastener 120A may be fixed to the second column 114 by using the structure above.

As shown in FIG. 4A to FIG. 5B, after the first connection and combination fastener 120A is assembled to the first column 112 or the second column 114, the second connection and combination fastener 120B is assembled to the first column 112 or the second column 114. The second connection and combination fastener 120B includes a second body portion 123, a first side portion 125A, a second side portion 125B, fastening structures C2 and C3, and at least one engagement structure FB. Two sides of the second body portion 123 respectively extend to form the first side portion 125A and the second side portion 125B. The engagement structure FB is formed on the first side portion 125A and the second side portion 125B. In this embodiment, the engagement structure FB is a protrusion which protrudes from the first side portion 125A and the second side portion 125B. The two fastening structures C2 and C3 include accommodating portions with holes C21 and C31. The engagement structure FB of the second connection and combination fastener 120B corresponds to the engagement structure FA of the first connection and combination fastener 120A, so that the first connection and combination fastener 120A and the second connection and combination fastener 120B are assembled together to form a connection and combination fastener 120 including three fastening structures C1, C2 and C3 and assembled to the first column 112 or the second column 114.

Figure 6B:
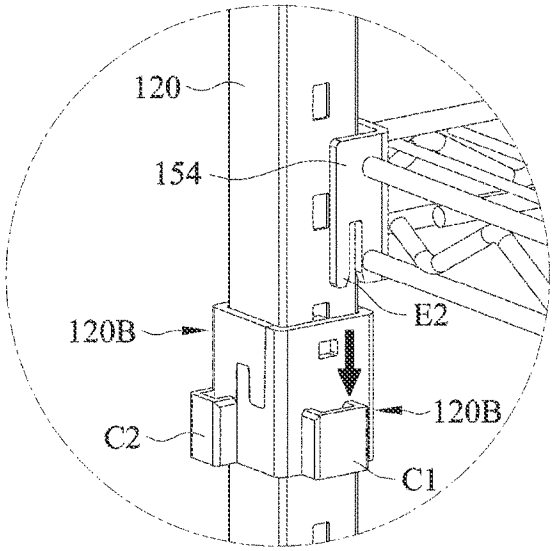
FIG. 6B is a partial enlarged view of a region A5 of FIG. 6A.
Figure 6C:
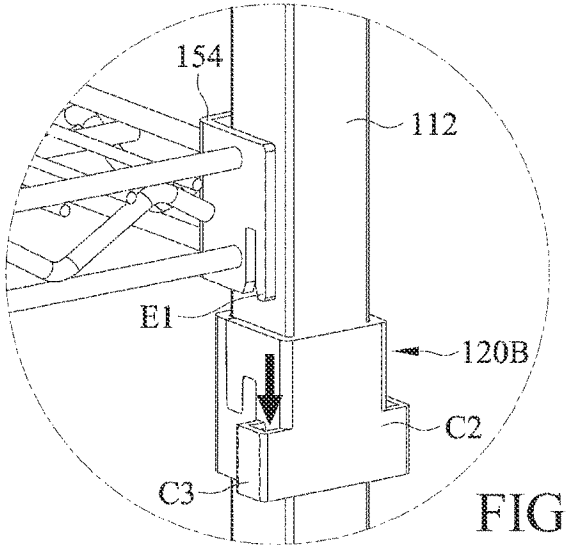
FIG. 6C is a partial enlarged view of a region A6 of FIG. 6A.
Figure 6A:
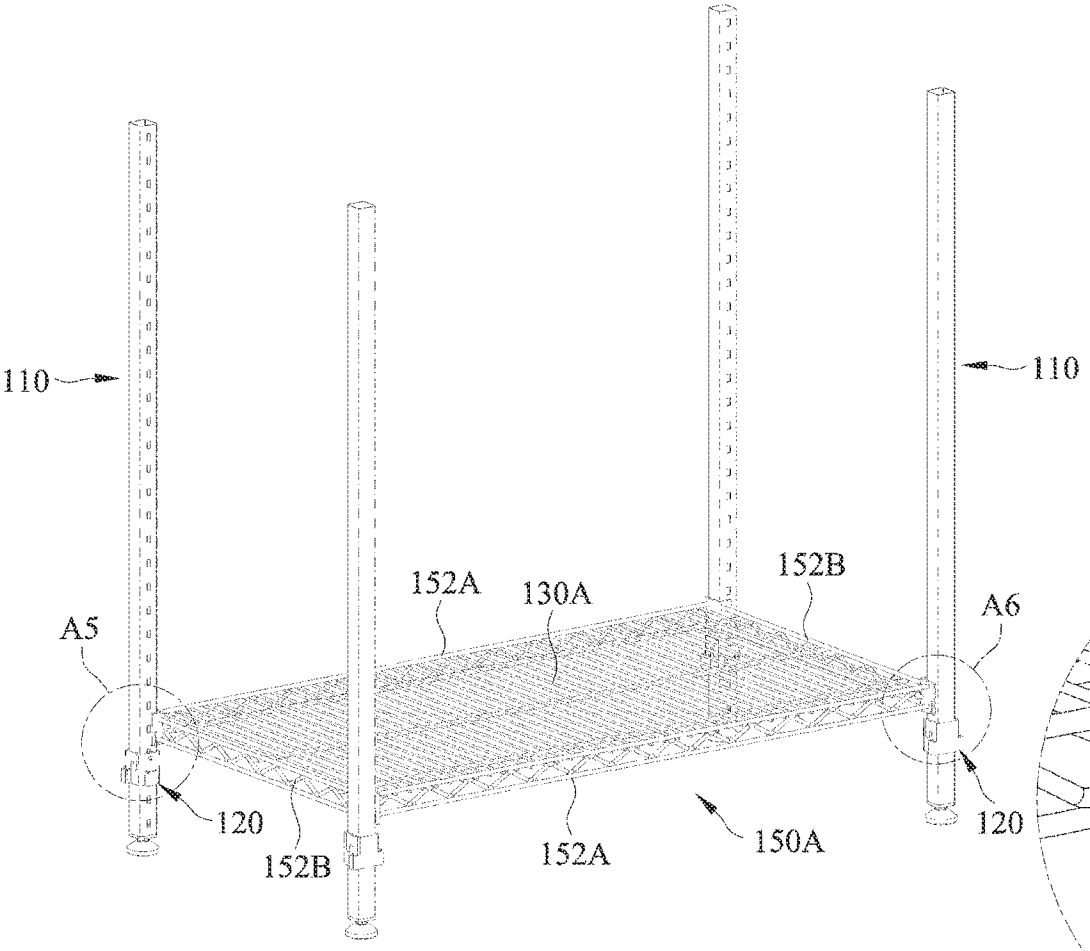
FIG. 6A is a schematic diagram of an assembly process of a first storage layer and a column combination in the combined storage shelf of FIG. 1.
Figure 7:
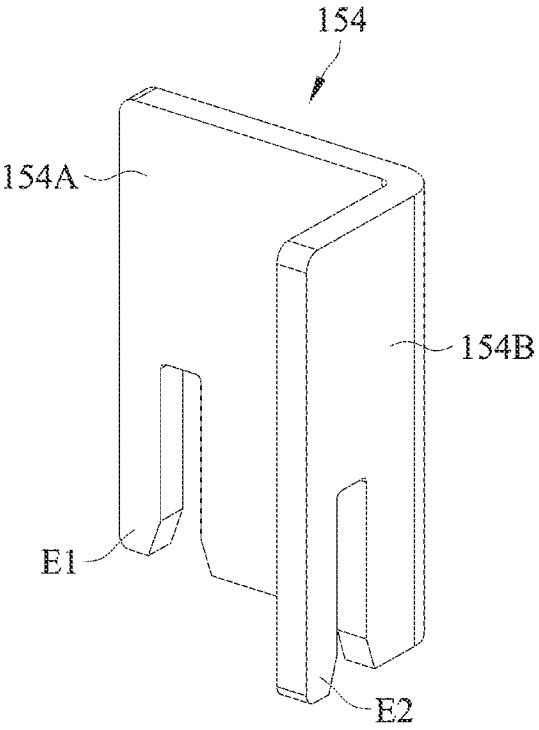
FIG. 7 is a schematic diagram of a beam connecting fastener.

FIG. 6A is a schematic diagram of an assembly process of a first storage layer and a column combination in the combined storage shelf of FIG. 1. FIG. 6B is a partial enlarged view of a region A5 of FIG. 6A. FIG. 6C is a partial enlarged view of a region A6 of FIG. 6A. FIG. 7 is a schematic diagram of a beam connecting fastener. In this embodiment, a beam structure 150A is disposed around the first storage layer 130A. The beam structure 150A includes two first beam members 152A, two second beam members 152B, and four beam connecting fasteners 154. The first beam members 152A are disposed on front and rear sides of the first storage layer 130A, and the second beam members 152B are disposed on left and right sides of the first storage layer 130A. The beam connecting fasteners 154 are configured to connect the first beam members 152A and the second beam members 152B. In this embodiment, each beam connecting fastener 154 includes a first sheet body 154A, a second sheet body 154B, and two beam fastening structures E1 and E2. The first sheet body 154A is vertically connected to the second sheet body 154B. The beam fastening structures E1 and E2 may be fastening blocks. The beam fastening structure E1 is located in the first sheet body 154A, and the beam fastening structure E2 is located in the second sheet body 154A. In addition, as shown in FIG. 6B or FIG. 6C, positions of the beam fastening structures E1 and E2 may correspond to positions of the fastening structures C1 and C2 (or C3), so that when the beam structure 150A as shown in FIG. 6A falls vertically, the beam fastening structures E1 and E2 are snapped into the corresponding fastening structures C1 and C2 (or C3), the beam structure 150A is connected to the corresponding connection and combination fasteners 120, and the first storage layer 130A is assembled to the column combination 110. Similarly, the beam structure 150B may also be connected to the corresponding connection and combination fasteners 120 by using the structure above. It should be noted that, the structure of a beam structure 150B is similar to that of the beam structure 150A. Details are not repeated herein again. Similarly, it can be inferred that other layers on the first row LL1 are also assembled by using the techniques. In addition, on the first row LL1, for example, a first storage shelf body M1, a second storage shelf body M2, or a third storage shelf body M3 can be appropriately assembled, and the shape thereof can be adjusted according to actual conditions. In addition, in FIG. 1, the first row LL1 includes connectors 5010, which can be used to combine a plurality of first columns 112 or second columns 114 with a fixed length, so that the length of the entire column combination 110 becomes longer. Certainly, in fact, the lengths of the first column 112 and the second column 114 may be directly increased, which may be unfavorable for transportation and placement. By assembling the plurality of first columns 112 and second columns 114 with the fixed length, the assembling convenience can be improved.

Figure 8A:
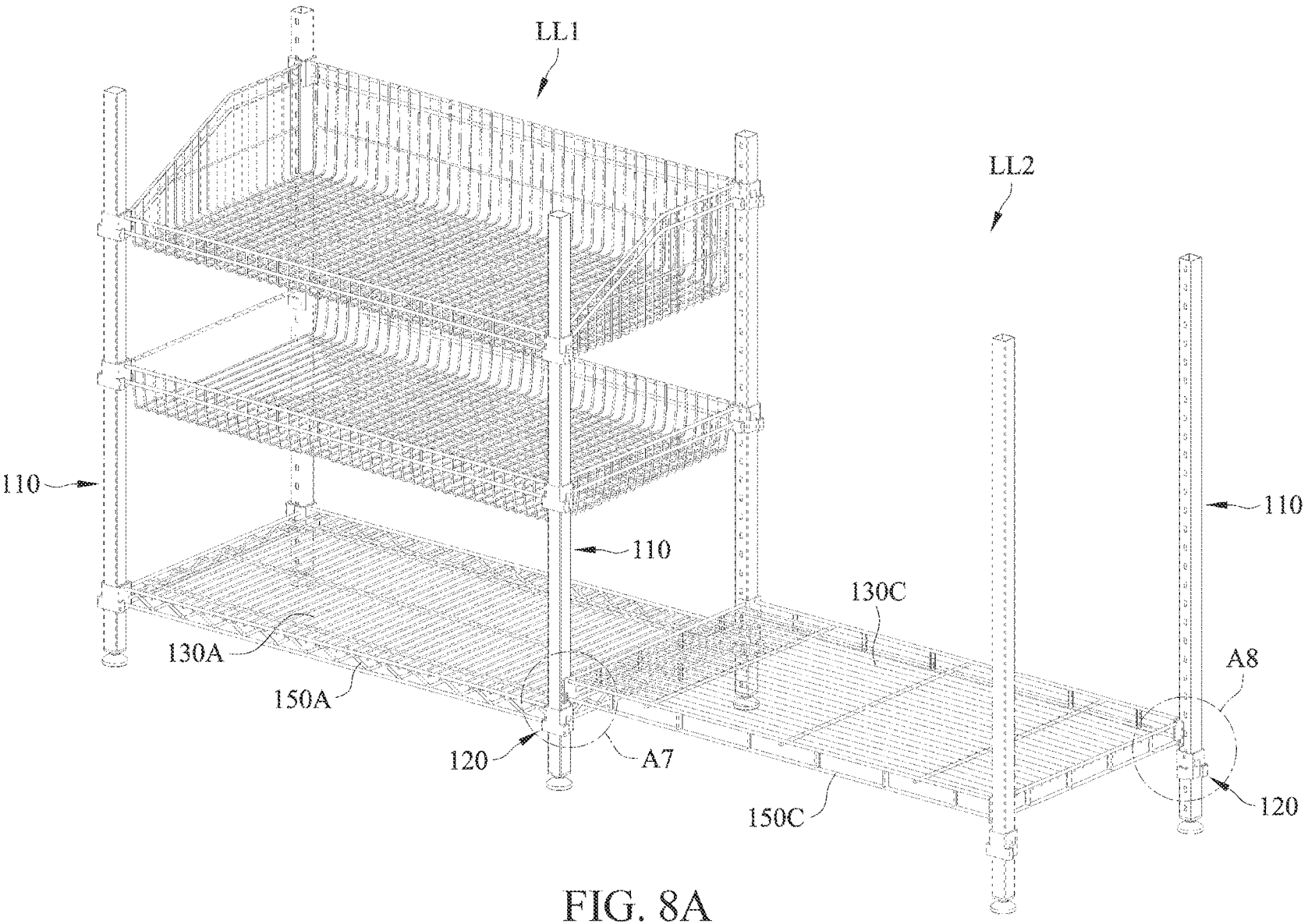
FIG. 8A is a schematic diagram of an assembly process of column combinations in FIG. 1.
Figure 8C:
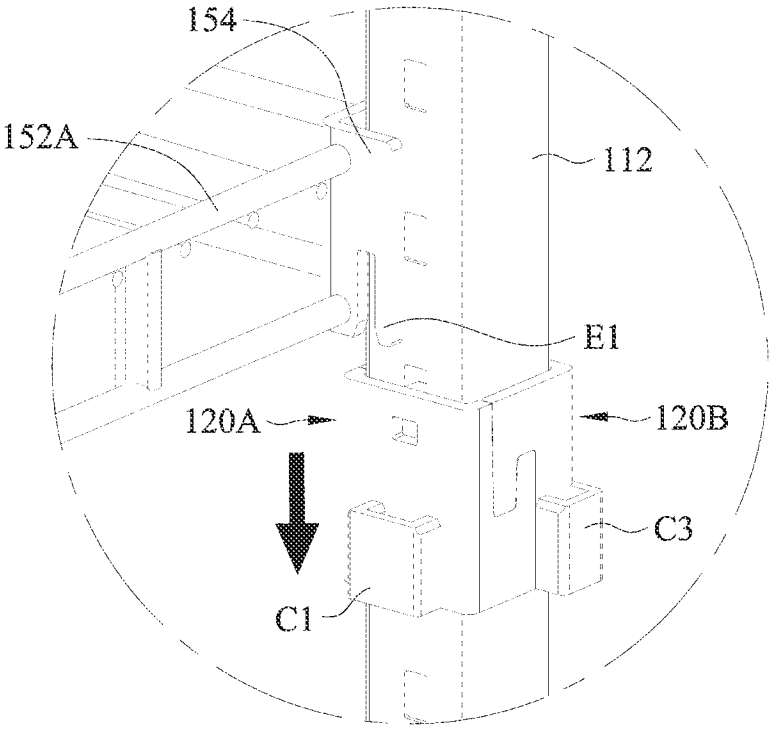
FIG. 8C is a partial enlarged view of a region A8 of FIG. 8A.
Figure 8B:
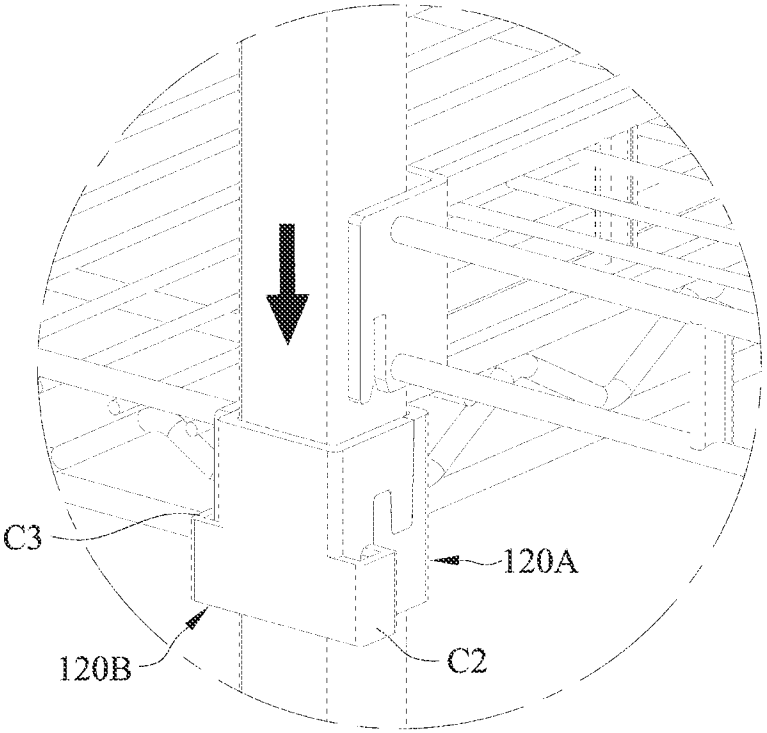
FIG. 8B is a partial enlarged view of a region A7 of FIG. 8A.

FIG. 8A is a schematic diagram of an assembly process of column combinations in FIG. 1. FIG. 8B is a partial enlarged view of a region A7 of FIG. 8A. FIG. 8C is a partial enlarged view of a region A8 of FIG. 8A. Referring to FIG. 8A to FIG. 8C, the connection and combination fastener 120 can be assembled with at least one fastening structure. For example, in this embodiment, there are three fastening structures C1, C2, and C3. After the connection and combination fastener 120 is assembled to the column combination 110 on the first row LL1, and if a second row LL2 is to be assembled next to the first row LL1, the connection and combination fastener 120 still includes a fastening structure C2 or C3 available for use. As shown in FIG. 8B or FIG. 8C, in this case, when the second row LL2 is assembled, the positions of the beam fastening structures E1 and E2 may correspond to the positions of the fastening structures C1 and C2 (or C3), so that when the beam structure 150C falls vertically, the beam fastening structures E1 and E2 are snapped into the corresponding fastening structures C1 and C2 (or C3), the beam structure 150C is connected to the corresponding connection and combination fasteners 120, and the third storage layer 130C can be assembled to the beam structure 150C. The structure and assembly method of the beam structure 150C are similar to those of the beam structure 150A described above. Details are not repeated herein again.

Figure 9:
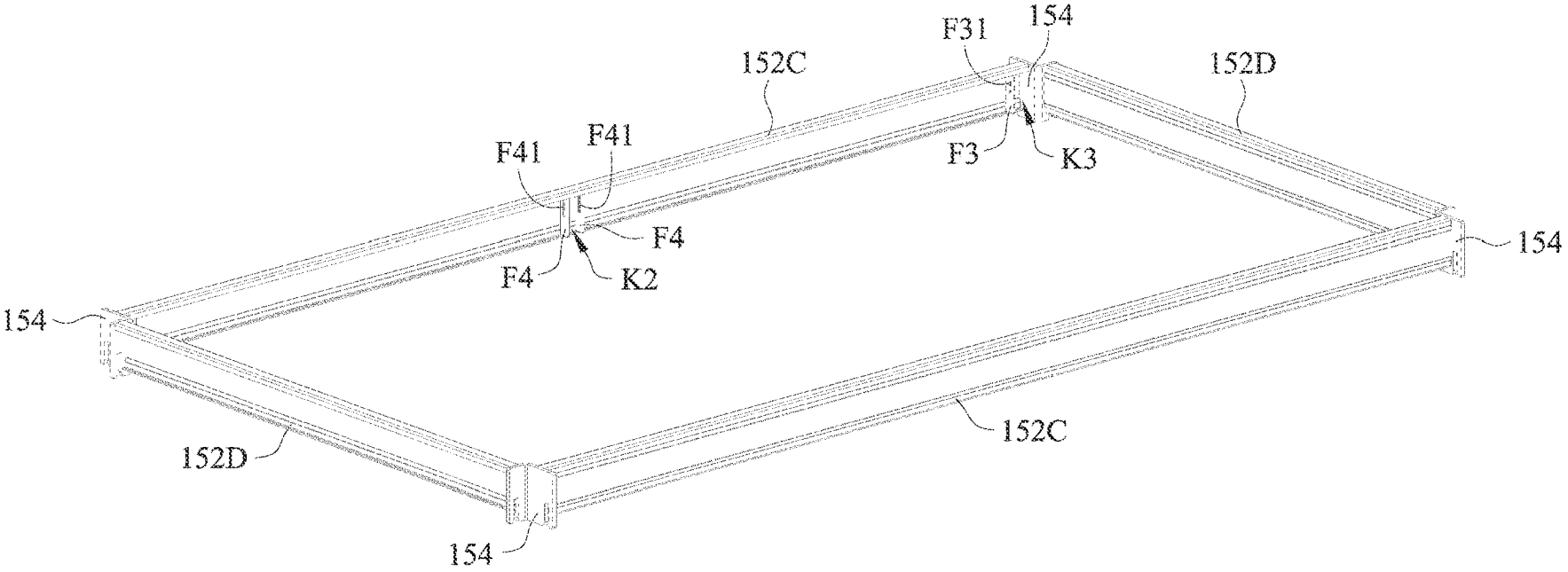
FIG. 9 is a schematic diagram of a beam structure according to an embodiment of the present disclosure.

In an embodiment, as shown in FIG. 1 and FIG. 9, the structure of a beam structure 150D is different from the structures of the beam structures 150A to 150C described above. The beam structure 150D may include two first beam members 152C, two second beam members 152D, four beam connecting fasteners 154, and a plurality of fitting portions F4. The two first beam members 152C are located on front and rear sides, and the two second beam members 152D are located on left and right sides. The beam connecting fasteners 154 are configured to connect the first beam members 152C and the second beam members 152D. The fitting portions F4 are connected to the first beam members 152C. As shown in FIG. 9, there are two fitting portions F4 in the middle of the first beam member 152C. The fitting portion F4 includes a fitting hole F41, which can be configured to hook a fitting, to improve the assembly flexibility of the present disclosure. A positioning slot K2 is provided between the two fitting portions F4. In FIG. 9, two sides of the first beam member 152C include fitting portions F3. A positioning slot K3 is formed between the fitting portion F3 and the corresponding beam connecting fastener 154.

Figure 10A:
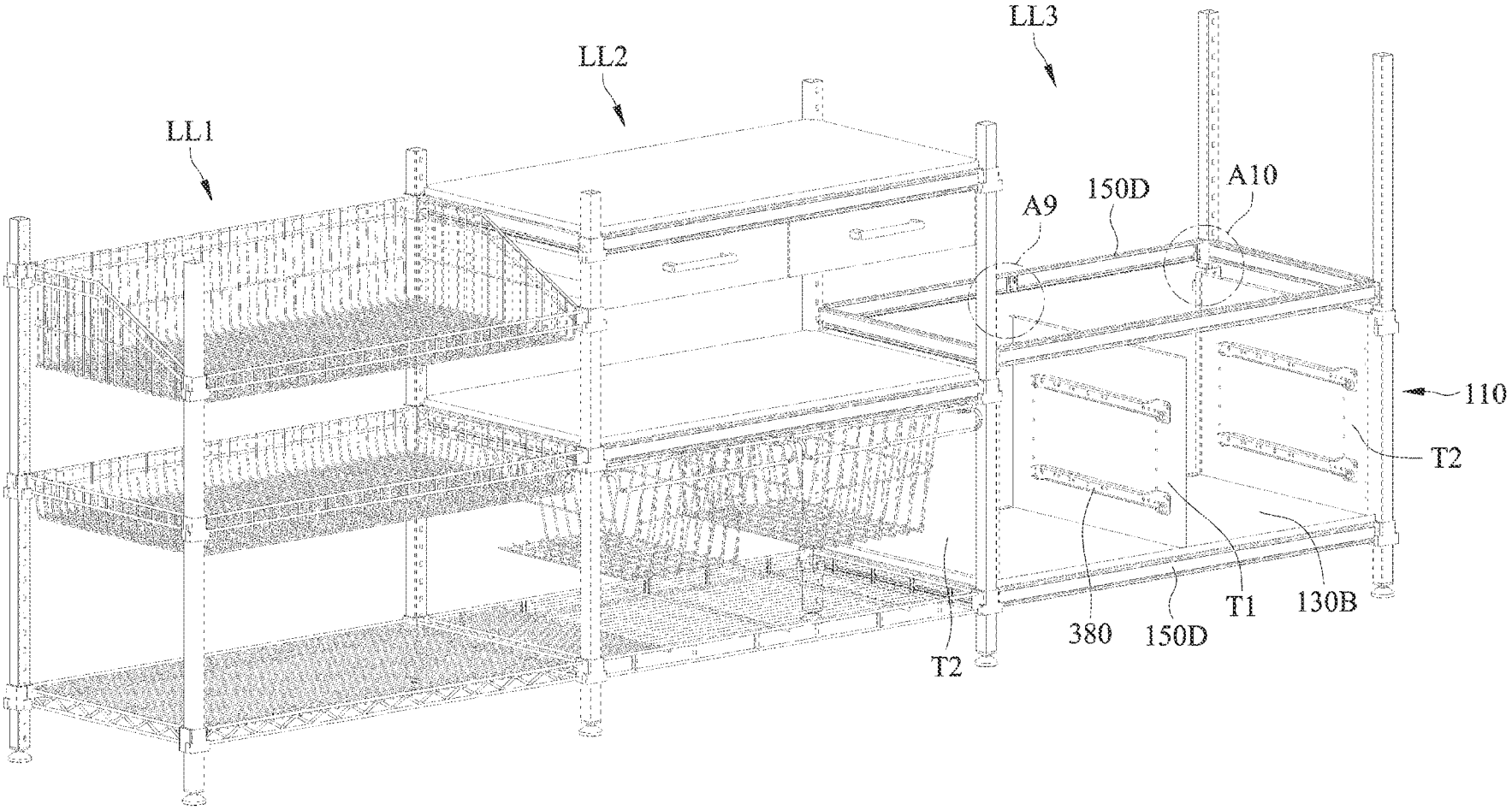
FIG. 10A is a schematic diagram of an assembly process of a combined storage shelf of the present disclosure.
Figure 10C:
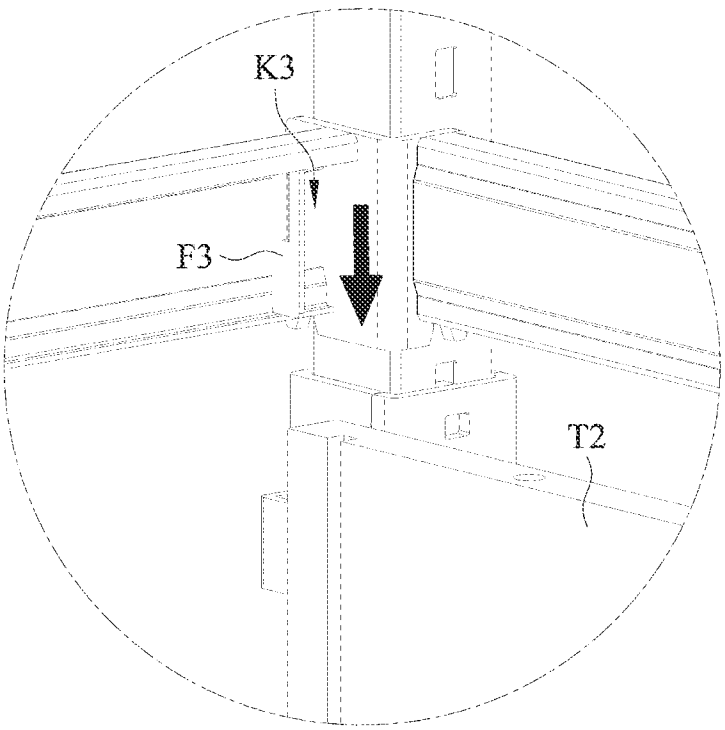
FIG. 10C is a partial enlarged view of a region A10 of FIG. 10A.
Figure 10B:
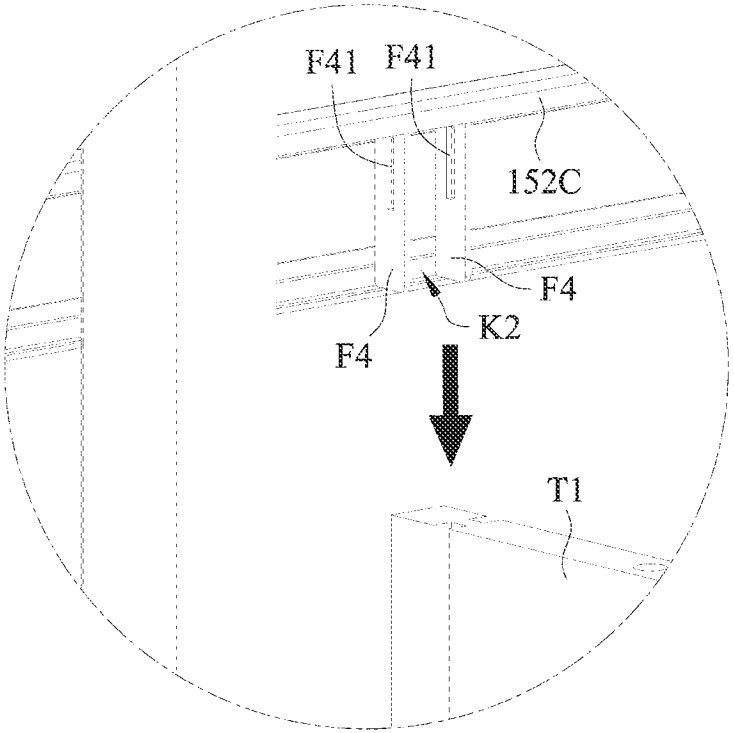
FIG. 10B is a partial enlarged view of a region A9 of FIG. 10A.

FIG. 10A is a schematic diagram of an assembly process of a combined storage shelf of the present disclosure. FIG. 10B is a partial enlarged view of a region A9 of FIG. 10A. FIG. 10C is a partial enlarged view of a region A10 of FIG. 10A. Referring to FIG. 10A to FIG. 10C, a first partition member T1 and a second partition member T2 are partition members disposed according to different positions. The first partition member T1 and two second partition members T2 are respectively disposed upright on a second storage layer 130B. The first partition member T1 and the two second partition members T2 are separated by a distance respectively. In addition, the first partition member T1 and the two second partition members T2 may include drawer track structures 380. In another embodiment, the drawer track structures 380 may not be disposed on the first partition member T1 and the two second partition members T2. The second storage layer 130B is different from mesh shapes of the first storage layer 130A and the third storage layer 130C, and the second storage layer 130B is flat.

In this embodiment, when the beam structure 150D falls, the partition member T1 and the partition member T2 can be inserted obliquely into the corresponding positioning slots K2 and K3 shown in FIG. 9. The partition members T1 and T2 can be quickly positioned, and the positioning slots K2 and K3 can hold the partition members, thereby positioning the partition members T1 and T2. In this way, the first partition member T1 and the second partition member T2 can form a drawer cabinet B1. That is, in this embodiment, by disposing the positioning slots K2 and K3 without locking, a drawer cabinet, a door cabinet or a storage cabinet can be assembled and located to save time and effort. In another embodiment, partition members such as the first partition member T1 and the second partition members T2 may be used to form a storage cabinet B2 or a door cabinet B3 (referring to FIG. 1), which depends on actual conditions.

The connection and combination fastener 120 includes three fastening structures C1, C2, and C3, so that there are fasteners on three surfaces of a square tube of the column combination 110, but the present disclosure is not limited thereto. FIG. 11A is a schematic diagram of a connection and combination fastener according to another embodiment of the present disclosure. FIG. 11B is an exploded view of a connection and combination fastener according to another embodiment of the present disclosure. FIG. 11C is a schematic diagram of FIG. 11B from different angles. Referring to FIG. 11A to FIG. 11C, the connection and combination fastener 220 includes a first connection and combination fastener 220A and a second connection and combination fastener 220B. The first connection and combination fastener 220A includes a first body portion 222, a fastening structure C1, two snap-fit portions G, and two engagement structures FC. Two sides of the first body portion 222 respectively extend to form the engagement structures FC. In this embodiment, the engagement structures FC are protrusions. The snap-fit portion G is a protrusion, which is formed on an inner side of the first body portion 222. The quantity of snap-fit portions G is, for example, two, whose size needs to match the configuration. The fastening structure C1 is an accommodating portion including a hole, which is formed on an outer side of the first body portion 222. In this embodiment, the structure of the first connection and combination fastener 220A is similar to the first connection and combination fastener 120A described above (as shown in FIG. 5A), and the connection method may refer to the text described in FIG. 3A to FIG. 3C. Each snap-fit portion G is snapped to the corresponding assembly hole 112B to fix the first connection and combination fastener 220A to the first column 112 or the second column 114.

The second connection and combination fastener 220B includes a second body portion 223, a first side portion 225A, a second side portion 225B, three fastening structures C2, C3, and C4, and at least one engagement structure FD. Two sides of the second body portion 223 respectively extend to form the first side portion 225A and the second side portion 225B. The engagement structure FD is formed on the first side portion 225A and the second side portion 225B. In this embodiment, the engagement structure FD is a recess which is recessed in the first side portion 225A and the second side portion 225B. The three fastening structures C2, C3, and C4 include accommodating portions with holes, which are respectively disposed on outer sides of the first side portion 225A, the second side portion 225B, and the second body portion 223. The engagement structure FD of the second connection and combination fastener 220B corresponds to the engagement structure FC of the first connection and combination fastener 220A, so that the first connection and combination fastener 220A and the second connection and combination fastener 220B are assembled together to form a connection and combination fastener 220 including four fastening structures C1, C2, C3, and C4 and assembled to the first column 112 or the second column 114.

Figure 12B:
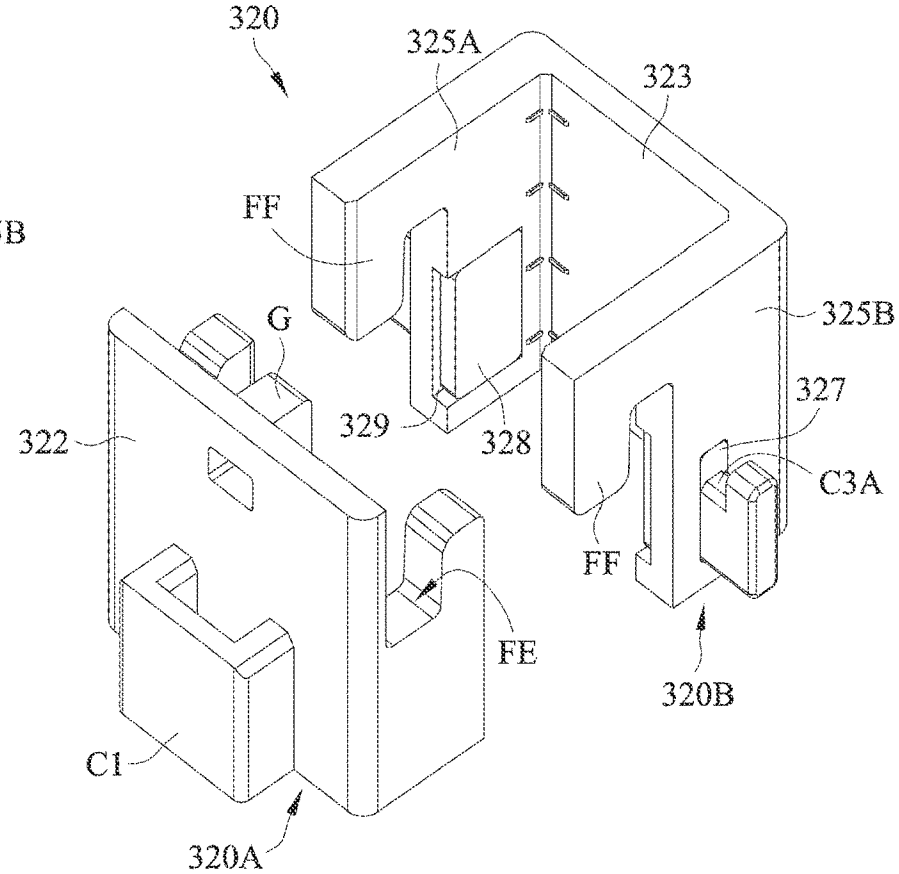
FIG. 12B is a schematic diagram of FIG. 12A from different angles.
Figure 12A:
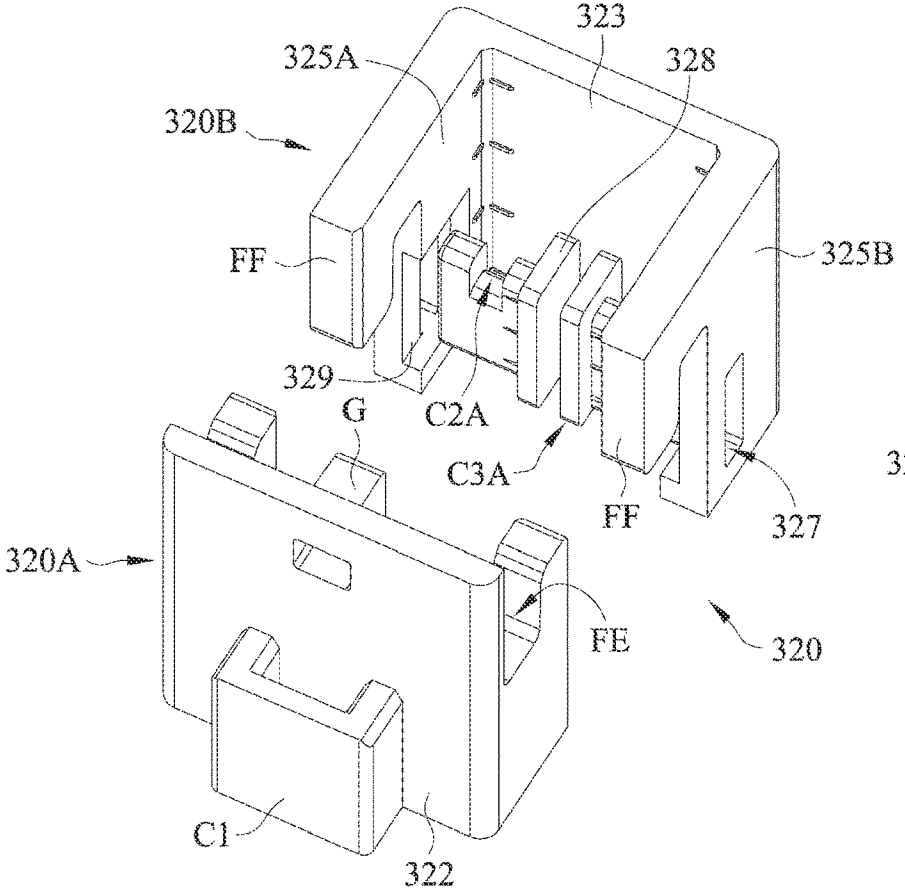
FIG. 12A is an exploded view of a connection and combination fastener according to another embodiment of the present disclosure.

FIG. 12A is an exploded view of a connection and combination fastener according to another embodiment of the present disclosure. FIG. 12B is a schematic diagram of FIG. 12A from different angles. Referring to FIG. 12A and FIG. 12B, different from the connection and combination fasteners 120 and 220 in the foregoing embodiments, a connection and combination fastener 320 in the present disclosure includes a movable fastening structure. The connection and combination fastener 320 includes a first connection and combination fastener 320A and a second connection and combination fastener 320B. The first connection and combination fastener 320A includes a first body portion 322, a fastening structure C1, two snap-fit portions G, and two engagement structures FE. Two sides of the first body portion 322 respectively extend to form the engagement structures FE. In this embodiment, the engagement structures FE are recesses. The snap-fit portion G is a protrusion, which is formed on an inner side of the first body portion 322. The quantity of snap-fit portions G is, for example, two, whose size needs to match the configuration. The fastening structure C1 is an accommodating portion including a hole, which is formed on an outer side of the first body portion 322. In this embodiment, the structure of the first connection and combination fastener 320A is similar to the first connection and combination fastener 120A described above (as shown in FIG. 5A), and the connection method may refer to the text described in FIG. 3A to FIG. 3C. Each snap-fit portion G is snapped to the corresponding assembly hole 112B to fix the first connection and combination fastener 320A to the first column 112 or the second column 114.

The second connection and combination fastener 320B includes a second body portion 323, a first side portion 325A, a second side portion 325B, two fastening structures C2A and C3A, and at least one engagement structure FF. Two sides of the second body portion 323 respectively extend to form the first side portion 325A and the second side portion 325B. The engagement structure FF is formed on the first side portion 325A and the second side portion 325B. In this embodiment, the engagement structure FF is a protrusion which protrudes from the first side portion 325A and the second side portion 325B.

Different from the fastening structures C2 and C3 in the foregoing embodiments, the fastening structures C2A and C3A in this embodiment are detachably disposed on outer sides of the first side portion 325A and the second side portion 325B respectively. The first side portion 325A and the second side portion 325B include a through holes 327 for the fastening structures C2A and C3A to pass through and be disposed on the outer sides of the first side portion 325A and the second side portion 325B. When the second connection and combination fastener 320B is hung on the column combination 110, the fastening structures C2A and C3A in the first side portion 325A and the second side portion 325B can be pushed out. In addition, a stopper 328 is clamped in a concave portion 329 in the first side portion 325A and the second side portion 325B, to fix the fastening structures C2A and C3A.

The engagement structure FF of the second connection and combination fastener 320B corresponds to the engagement structure FE of the first connection and combination fastener 320A, so that the first connection and combination fastener 320A and the second connection and combination fastener 320B are assembled together to form a connection and combination fastener 320 including 3 fastening structures C1, C2 and C3 and assembled to the first column 112 or the second column 114.

In conclusion, the combined storage shelf provided by the present invention can utilize the assembly holes, the connection and combination fasteners, and the beam structures of the column combinations to achieve the purpose of assembling the combined storage shelf without tools, and can implement a horizontal and extending connection to achieve the purpose of flexibility in the overall assembly.

Furthermore, the beam structure has a hooking function, and a fitting may be added according to actual needs, to make the combined storage shelf more flexible in assembly.

In addition, in the present invention, the method of disposing the positioning slots on the beam structure without locking is adopted, so that a drawer cabinet, a door cabinet or a storage cabinet can be assembled and positioned to save time and effort.

Although the present invention is disclosed above with embodiments, the embodiments are not intended to limit the present invention. Any person of ordinary skill in the art may make variations and modifications without departing from the spirit and scope of the present invention. Therefore, the protection scope of the present invention should be subject to the appended claims.

What is claimed is:

1. A combined storage shelf, comprising:

a plurality of column combinations, comprising a plurality of assembly holes;

a plurality of connection and combination fasteners, wherein each of the connection and combination fasteners comprises a first connection and combination fastener and a second connection and combination fastener, each of the first connection and combination fastener and the second connection and combination fastener comprises a body portion, at least one fastening structure, and at least one engagement structure, the at least one fastening structure is formed on an outer side of the body portion, and the at least one engagement structure is disposed on two sides of the body portion;

each of the first connection and combination fasteners comprises at least one snap-fit portion, and each snap-fit portion is snapped to a corresponding assembly hole, to fix the respective first connection and combination fastener to the respective column combination; and the engagement structure of each of the second connection and combination fasteners corresponds to the engagement structure of the respective first connection and combination fastener, so that the first connection and combination fastener and the second connection and combination fastener are assembled together;

a plurality of beam structures, wherein each of the beam structures comprises two first beam members, two second beam members, four beam connecting fasteners, and a plurality of beam fastening structures, the beam connecting fasteners are configured to connect the first beam members and the second beam members together, the beam fastening structures are disposed on the beam connecting fasteners, and each of the beam fastening structures is snapped into a corresponding fastening structure, so that the beam structures are connected to the corresponding connection and combination fasteners; and a plurality of storage layers, disposed between the column combinations, wherein the beam structures support the corresponding storage layers;

wherein each of the column combinations comprises two columns, wherein each of the two columns includes a tube body and the tube body is a hollow square tube, wherein the plurality of assembly holes are sequentially arranged on at least one surface of each of the two columns, wherein each assembly hole is a square shaped opening having four sides, wherein the four sides of each assembly hole have a same size.

2. The combined storage shelf according to claim 1, further comprising:

a plurality of fitting portions, wherein the fitting portions are connected to the first beam members, and each of the fitting portions comprises a hook hole.

3. The combined storage shelf according to claim 2, further comprising:

a plurality of positioning slots, provided in the first beam members, wherein the positioning slots hold at least one corresponding partition member, to position the partition members on the storage layer.

4. The combined storage shelf according to claim 3, wherein the partition members are capable of forming a drawer cabinet, a door cabinet, or a storage cabinet.

5. The combined storage shelf according to claim 1, wherein the two columns of each of the column combinations are a first column and a second column, wherein assembly holes of the first column and assembly holes of the second column face each other.

6. The combined storage shelf according to claim 1, wherein the plurality of assembly holes are sequentially arranged in an assembly direction, wherein the assembly direction is a top-to-bottom direction.

* * * * *